US011248452B2

(12) United States Patent
Sullivan et al.

(10) Patent No.: US 11,248,452 B2
(45) Date of Patent: Feb. 15, 2022

(54) BULKHEAD ASSEMBLY FOR A TANDEM SUB, AND AN IMPROVED TANDEM SUB

(71) Applicant: XConnect, LLC, Denver, CO (US)

(72) Inventors: Shelby L. Sullivan, Minot, ND (US); Aaron Holmberg, Omaha, NE (US); Kelly J. Sullivan, Pengilly, MN (US)

(73) Assignee: XConnect, LLC, Denver, CO (US)

( * ) Notice: Subject to any disclaimer, the term of this patent is extended or adjusted under 35 U.S.C. 154(b) by 0 days.

(21) Appl. No.: 17/110,757

(22) Filed: Dec. 3, 2020

(65) Prior Publication Data

US 2021/0087909 A1 Mar. 25, 2021

Related U.S. Application Data

(62) Division of application No. 16/836,193, filed on Mar. 31, 2020, now Pat. No. 10,914,145.

(60) Provisional application No. 62/827,403, filed on Apr. 1, 2019, provisional application No. 62/845,692, filed on May 9, 2019.

(51) Int. Cl.
*E21B 43/119* (2006.01)
*E21B 43/117* (2006.01)

(52) U.S. Cl.
CPC ..... *E21B 43/117* (2013.01); *E21B 43/119* (2013.01)

(58) Field of Classification Search
CPC ..... E21B 43/117; E21B 43/119
USPC ..... 175/4.55
See application file for complete search history.

(56) References Cited

U.S. PATENT DOCUMENTS

| | | | |
|---|---|---|---|
| 2,418,486 | A | 4/1947 | Smylie |
| 3,173,992 | A | 3/1965 | Boop |
| 4,007,790 | A | 2/1977 | Henning |
| 4,007,796 | A | 2/1977 | Boop |
| 4,058,061 | A | 11/1977 | Mansur, Jr. et al. |

(Continued)

FOREIGN PATENT DOCUMENTS

| | | | |
|---|---|---|---|
| CA | 2821506 | A1 | 1/2015 |
| CA | 2824838 | A1 | 2/2015 |

(Continued)

OTHER PUBLICATIONS

Screen Shot of CircuPool Flow Switch Housing(R); https://www.circupool.com/CircuPool%C2%AE-Flow-Switch-Housing_p_237.html; 2 pages.

(Continued)

*Primary Examiner* — Reginald S Tillman, Jr.
(74) *Attorney, Agent, or Firm* — Peter L. Brewer; Thrive IP

(57) ABSTRACT

A bulkhead assembly for transmitting current to a downhole tool such as a perforating gun. The bulkhead assembly comprises a tubular bulkhead body having a bore therein. The bulkhead assembly also includes an electrical contact pin. The contact pin comprises a shaft having a first end and a second end. The shaft is fabricated substantially from brass and comprises a plurality of grooves. At the same time, the bore comprises a profile for mating with and receiving the grooves. This grooved, mating arrangement increases shear strength of the bulkhead assembly. Preferably, a first end of the electrical contact pin is in electrical communication with a wire within a wellbore. The wire transmits electrical signals from an operator at the surface. The shaft comprises a conical portion proximate the first end that fits into a mating conical profile of the bore. A tandem sub having an improved electrical communication is also provided.

7 Claims, 8 Drawing Sheets

(56) References Cited

U.S. PATENT DOCUMENTS

| | | | |
|---|---|---|---|
| 4,100,978 | A | 7/1978 | Boop |
| 4,140,188 | A | 2/1979 | Vann |
| 4,182,216 | A | 1/1980 | DeCaro |
| 4,266,613 | A | 5/1981 | Boop |
| 4,411,491 | A | 10/1983 | Larkin et al. |
| 4,491,185 | A | 1/1985 | McClure |
| 4,523,650 | A | 6/1985 | Sehnert et al. |
| 4,574,892 | A | 3/1986 | Grigar et al. |
| 4,621,396 | A | 11/1986 | Walker et al. |
| 4,650,009 | A | 3/1987 | McClure et al. |
| 4,660,910 | A | 4/1987 | Sharp et al. |
| 4,747,201 | A | 5/1988 | Donovan et al. |
| 4,850,438 | A | 7/1989 | Regalbuto |
| 5,027,708 | A | 7/1991 | Gonzalez et al. |
| 5,042,594 | A | 8/1991 | Gonzalez et al. |
| 5,052,489 | A | 10/1991 | Carisella et al. |
| 5,223,665 | A | 6/1993 | Burleson et al. |
| 5,237,136 | A | 8/1993 | Langston |
| 5,347,929 | A | 9/1994 | Lerche et al. |
| 5,603,384 | A | 2/1997 | Bethel et al. |
| 5,703,319 | A | 12/1997 | Fritz et al. |
| 5,871,052 | A | 2/1999 | Benson et al. |
| D417,252 | S | 11/1999 | Kay |
| 6,006,833 | A | 12/1999 | Burleson et al. |
| 6,263,283 | B1 | 7/2001 | Snider et al. |
| 6,497,285 | B2 | 12/2002 | Walker |
| 6,516,901 | B1 | 2/2003 | Falgout, Sr. |
| 6,651,747 | B2 | 11/2003 | Chen et al. |
| 7,013,977 | B2 | 3/2006 | Nordaas |
| 7,193,527 | B2 | 3/2007 | Hall et al. |
| 7,278,491 | B2 | 10/2007 | Scott |
| 7,591,212 | B2 | 9/2009 | Myers, Jr. et al. |
| 7,661,474 | B2 | 2/2010 | Campbell et al. |
| 7,929,270 | B2 | 4/2011 | Hummel et al. |
| 8,069,789 | B2 | 12/2011 | Hummel et al. |
| 8,079,296 | B2 | 12/2011 | Barton et al. |
| 8,439,114 | B2 | 5/2013 | Parrott et al. |
| 8,869,887 | B2 | 10/2014 | Deere et al. |
| 8,875,787 | B2 | 11/2014 | Tassaroli |
| 9,145,764 | B2 | 9/2015 | Burton et al. |
| 9,206,675 | B2 | 12/2015 | Hales et al. |
| 9,284,819 | B2 | 3/2016 | Tolman et al. |
| 9,441,465 | B2 | 9/2016 | Tassaroli |
| 9,494,021 | B2 | 11/2016 | Parks et al. |
| 9,574,416 | B2 | 2/2017 | Wright et al. |
| 9,581,422 | B2 | 2/2017 | Preiss et al. |
| 9,605,937 | B2 | 3/2017 | Eitschberger et al. |
| 9,617,829 | B2 | 4/2017 | Dale et al. |
| 9,702,680 | B2 | 7/2017 | Parks et al. |
| 9,784,549 | B2 | 10/2017 | Eitschberger |
| 9,822,618 | B2 | 11/2017 | Eitschberger |
| 9,903,192 | B2 | 2/2018 | Entchev et al. |
| 10,053,968 | B2 | 8/2018 | Tolman et al. |
| 10,066,921 | B2 | 9/2018 | Eitschberger |
| 10,077,641 | B2 | 9/2018 | Rogman et al. |
| 10,138,713 | B2 | 11/2018 | Tolman et al. |
| 10,151,152 | B2 | 12/2018 | Wight et al. |
| 10,161,733 | B2 | 12/2018 | Eitschberger et al. |
| 10,174,595 | B2 | 1/2019 | Knight et al. |
| 10,352,136 | B2 | 7/2019 | Goyeneche |
| 10,352,144 | B2 | 7/2019 | Entchev et al. |
| 10,352,674 | B2 | 7/2019 | Eitschberger |
| 10,429,161 | B2 | 10/2019 | Parks et al. |
| 10,458,213 | B1 | 10/2019 | Eitschberger et al. |
| 10,472,938 | B2 | 11/2019 | Parks et al. |
| 10,507,433 | B2 | 12/2019 | Eitschberger et al. |
| 10,597,979 | B1 | 3/2020 | Eitschberger et al. |
| 10,844,696 | B2 | 11/2020 | Eitschberger et al. |
| 10,844,697 | B2 | 11/2020 | Preiss et al. |
| D904,475 | S | 12/2020 | Preiss et al. |
| 10,900,334 | B2 | 1/2021 | Knight et al. |
| 10,900,335 | B2 | 1/2021 | Knight et al. |
| 2005/0229805 | A1 | 10/2005 | Myers et al. |
| 2010/0089643 | A1 | 4/2010 | Vidal |
| 2013/0062055 | A1 | 3/2013 | Tolman et al. |
| 2014/0131035 | A1 | 5/2014 | Entchev et al. |
| 2015/0136419 | A1 | 5/2015 | Mauldin |
| 2015/0330192 | A1 | 11/2015 | Rogman et al. |
| 2016/0040520 | A1 | 2/2016 | Tolman et al. |
| 2016/0061572 | A1 | 3/2016 | Eitschberger et al. |
| 2016/0069163 | A1 | 3/2016 | Tolman et al. |
| 2016/0084048 | A1 | 3/2016 | Harrigan et al. |
| 2016/0168961 | A1 | 6/2016 | Parks et al. |
| 2016/0273902 | A1 | 9/2016 | Eitschberger |
| 2017/0030693 | A1 | 2/2017 | Preiss et al. |
| 2017/0052011 | A1 | 2/2017 | Parks et al. |
| 2017/0268860 | A1 | 9/2017 | Eitschberger |
| 2017/0276465 | A1 | 9/2017 | Parks et al. |
| 2017/0314372 | A1 | 11/2017 | Tolman et al. |
| 2018/0119529 | A1 | 5/2018 | Goyeneche |
| 2018/0135398 | A1 | 5/2018 | Entchev et al. |
| 2018/0202789 | A1 | 7/2018 | Parks et al. |
| 2018/0202790 | A1 | 7/2018 | Parks et al. |
| 2018/0299239 | A1 | 10/2018 | Eitschberger et al. |
| 2018/0318770 | A1 | 11/2018 | Eitschberger et al. |
| 2019/0049225 | A1 | 2/2019 | Eitschberger |
| 2019/0234188 | A1 | 8/2019 | Goyeneche |
| 2019/0257158 | A1 | 8/2019 | Langford et al. |
| 2019/0257181 | A1 | 8/2019 | Langford et al. |
| 2020/0024934 | A1 | 1/2020 | Eitschberger et al. |
| 2020/0024935 | A1 | 1/2020 | Eitschberger et al. |
| 2020/0032626 | A1 | 1/2020 | Parks et al. |
| 2020/0088011 | A1 | 3/2020 | Eitschberger et al. |
| 2020/0199983 | A1 | 6/2020 | Preiss et al. |
| 2020/0308938 | A1 | 10/2020 | Sullivan et al. |
| 2020/0399995 | A1 | 12/2020 | Preiss et al. |
| 2021/0172298 | A1 | 6/2021 | Knight et al. |
| 2021/0189846 | A1 | 6/2021 | Bradley et al. |
| 2021/0222526 | A1 | 7/2021 | Preiss et al. |
| 2021/0223007 | A1 | 7/2021 | Kash et al. |

FOREIGN PATENT DOCUMENTS

| | | | |
|---|---|---|---|
| CA | 3021913 | A1 | 2/2018 |
| GB | 2531450 | B | 2/2017 |
| GB | 2548203 | A | 9/2017 |
| WO | 2017147329 | A1 | 8/2017 |

OTHER PUBLICATIONS

Screen Shot of Chaparral Performance Machine Contour FL Right Side 5 Button Switch Housing; https://www.chapmoto.com/performance-machine-contour-fl-right-side-5-button-switch-housing-parent-397-pm3081; 2 pages.

Screen shot of OsoLite® Lite'n Your Workload with Oso's Prewired, Disposable Perforating Gun System; https://www.osoperf.com/perf-hardware/osolite; Date of access of Feb. 1, 2021; 2 pages.

Screen shot of SWM International Inc. Thunder Disposable Gun System; https://web.archive.org/web/20200109183633/http:/swmtx.com/pdf/thunder_gun.pdf; Date of access of Feb. 1, 2021; 5 pages.

Screen shot of Yellow Jacket Oil Tools: Perforating Guns; https://www.yjoiltools.com/perforating-guns; Date of access of Feb. 1, 2021; 1 page.

Screen shot of Nexus Perforating: Double Nexus Connect (Thunder Gun System); https://www.yjoiltools.com/perforating-guns; Date of access of Feb. 1, 2021; 1 page.

Screen shot of VIGOR USA: Perforating Gun Accessories—Economical and Dependable Perforating Gun Accessories; https://vigorusa.com/perforating-gun-accessories/; Date of access of Feb. 1, 2021; 2 page.

Screen shot of Yellow Jacket Oil Tools: Pre-Wired Perforating Gun; https://www.yjoiltools.com/Perforating-Guns/Pre-Wired-Perforating-Gun; Date of access of Feb. 1, 2021; 1 page.

Screen shot of GR Energy Services—ZipFire™ ReFrac gun system; https://www.grenergyservices.com/zipfire-refrac/; Date of access of Feb. 1, 2021; 2 pages.

Screen shot of GR Energy Services—ZipFire™ high-efficiency perforating system answers current completion demands for higher stage-per-day performance; https://www.grenergyservices.com/zipfire/; date of access of Feb. 1, 2021; 2 pages.

(56) References Cited

OTHER PUBLICATIONS

Screen shot of Rock Faithwell—Perforating Gun System; http://www.cnrock.com.cn/h-col-116.html; date of access of Feb. 1, 2021; 2 pages.
Screen shot of APT American—Perforating Guns; https://aptamerican.com/perforating-guns; date of access of Feb. 1, 2021; 1 page.
Screen shot of NexTier—Innovative Solutions: GameChanger™ Perforating System; https://nextierofs.com/solutions/innovative-solutions/gamechanger/; date of access of Feb. 1, 2021; 2 pages.

BULKHEAD ASSEMBLY FOR A TANDEM SUB, AND AN IMPROVED TANDEM SUB

CROSS REFERENCE TO RELATED APPLICATIONS

This application claims the benefit of U.S. Ser. No. 62/827,403 filed Apr. 1, 2019. That application is entitled "A Bulkhead Assembly for a Tandem Sub, and an Improved Tandem Sub."

This application also claims the benefit of U.S. Ser. No. 62/845,692 filed May 9, 2019. That application is entitled "Bulkhead Assembly for Downhole Perforating Tool."

Each of these applications is incorporated herein by reference in its entirety.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD OF THE INVENTION

The present disclosure relates to the field of hydrocarbon recovery operations. More specifically, the invention relates to a tandem sub used to mechanically and electrically connect perforating guns along a perforating gun assembly. The invention also pertains to a bulkhead assembly used to transmit detonation signals from the surface to a perforating gun downhole.

Technology in the Field of the Invention

In the drilling of an oil and gas well, a near-vertical wellbore is formed through the earth using a drill bit urged downwardly at a lower end of a drill string. After drilling to a predetermined depth, the drill string and bit are removed and the wellbore is lined with a string of casing. An annular area is thus formed between the string of casing and the formation penetrated by the wellbore.

A cementing operation is conducted in order to fill or "squeeze" the annular volume with cement along part or all of the length of the wellbore. The combination of cement and casing strengthens the wellbore and facilitates the zonal isolation of aquitards and hydrocarbon-producing zones behind the casing.

In connection with the completion of the wellbore, several strings of casing having progressively smaller outer diameters will be cemented into the wellbore. These will include a string of surface casing, one or more strings of intermediate casing, and finally a production casing. The process of drilling and then cementing progressively smaller strings of casing is repeated until the well has reached total depth. In some instances, the final string of casing is a liner, that is, a string of casing that is not tied back to the surface.

Within the last two decades, advances in drilling technology have enabled oil and gas operators to economically "kick-off" and steer wellbore trajectories from a generally vertical orientation to a generally horizontal orientation. The horizontal "leg" of each of these wellbores now often exceeds a length of one mile, and sometimes two or even three miles. This significantly multiplies the wellbore exposure to a target hydrocarbon-bearing formation (or "pay zone"). The horizontal leg will typically include the production casing.

FIG. 1 is a side, cross-sectional view of a wellbore 100, in one embodiment. The wellbore 100 has been completed horizontally, that is, it has a horizontal leg 156. The wellbore 100 defines a bore 10 that has been drilled from an earth surface 105 into a subsurface 110. The wellbore 100 is formed using any known drilling mechanism, but preferably using a land-based rig or an offshore drilling rig operating on a platform.

The wellbore 100 is completed with a first string of casing 120, sometimes referred to as surface casing. The wellbore 100 is further completed with a second string of casing 130, typically referred to as an intermediate casing. In deeper wells, that is wells completed below 7,500 feet, at least two intermediate strings of casing will be used. In FIG. 1, a second intermediate string of casing is shown at 140.

The wellbore 100 is finally completed with a string of production casing 150. In the view of FIG. 1, the production casing 150 extends from the surface 105 down to a subsurface formation, or "pay zone" 115. The wellbore is completed horizontally, meaning that a horizontal "leg" 156 is provided. The leg 156 includes a heel 153 and a toe 154. The heel 153 may be referred to as a transition section, while the toe 154 defines the end (or "TD") of the wellbore 100. The production casing 150 will also extend along the horizontal leg 156.

It is observed that the annular region around the surface casing 120 is filled with cement 125. The cement (or cement matrix) 125 serves to isolate the wellbore from fresh water zones and potentially porous formations around the casing string 120.

The annular regions around the intermediate casing strings 130, 140 are also filled with cement 135, 145. Similarly, the annular region around the production casing 150 is filled with cement 155. However, the cement 135, 145, 155 is optionally only placed behind the respective casing strings 130, 140, 150 up to the lowest joints of the immediately surrounding casing strings. Thus, for example, a non-cemented annular area 132 may be preserved above the cement matrix 135, and a non-cemented annular area 152 is frequently preserved above the cement matrix 155.

In order to enhance the recovery of hydrocarbons, particularly in low-permeability formations 115, the casing 150 along the horizontal section 156 undergoes a process of perforating and fracturing (or in some cases perforating and acidizing). Due to the very long lengths of new horizontal wells, the perforating and formation treatment process is typically carried out in stages.

In one method, a perforating gun assembly (shown schematically at 200) is pumped down towards the end of the horizontal leg 156 at the end of a wireline 240. The perforating gun assembly 200 will include a series of perforating guns, with each gun having sets of charges ready for detonation. A plug setting tool 160 is placed at the end of the perforating gun assembly 200.

In operation, the perforating gun assembly 200 is pumped down towards the end 154 of the wellbore 100. The charges associated with one of the perforating guns are detonated and perforations are "shot" into the casing 150. Those of ordinary skill in the art will understand that a perforating gun has explosive charges, typically shaped, hollow or projectile charges, which are ignited to create holes in the casing (and, if present, the surrounding cement) 150 and to pass at least a few inches and possibly several feet into the formation 115. The perforations (not shown) create fluid communication with the surrounding formation 115 so that hydrocarbons can flow into the casing 150.

After perforating, the operator will fracture (or otherwise stimulate) the formation 115 through the perforations. This is done by pumping treatment fluids into the formation 115 at a pressure above a formation parting pressure.

After the fracturing operation is complete, the wireline 240 will be raised and the perforating gun assembly 200 will be positioned at a new location (or "depth") along the horizontal wellbore 156. A plug 112 is set below the perforating gun assembly 200 and new shots are fired in order to create a new set of perforations (not shown). Thereafter, treatment fluid is again pumped into the wellbore 100 and into the formation 115 at a pressure above the formation parting pressure. In this way, a second set (or "cluster") of fractures is formed away from the wellbore.

The process of setting a plug, perforating the casing, and fracturing the formation is repeated in multiple stages until the wellbore has been completed, that is, it is ready for production.

In order to provide perforations for the multiple stages without having to pull the perforating gun after every detonation, the perforating gun assembly 200 employs multiple guns in series. FIG. 2 is a side view of an illustrative perforating gun assembly 200, or at least a portion of the assembly. The perforating gun assembly 200 comprises a string of perforating guns 210.

Each perforating gun 210 represents various components. These typically include a "gun barrel" 212 which serves as an outer tubular housing. An uppermost gun barrel 210 is supported by an electric wire (or "e-line") 240 that extends from the surface and that delivers electrical energy down to the tool string 200. Each perforating gun 210 also includes an explosive initiator, or "detonator" (not shown) that receives electrical energy. In addition, each perforating gun 210 comprises a detonating cord (also not shown). The detonating cord contains an explosive compound that is ignited by the detonator. The detonator, in turn, initiates shots, or "shaped charges."

The detonator defines a small aluminum housing having a resistor inside. The resister is surrounded by a sensitive explosive material. When current is run through the detonator, a small explosion is set off by the electrically heated resistor. This small explosion sets off the detonator cord. The detonator cord is a plastic straw which itself is packed with an explosive material such as RDX. As the RDX is ignited, the detonating cord delivers the explosion to shaped charges along the first perforating gun.

The charges are held in an inner tube, referred to as a carrier tube, for security. The charges are discharged through openings 215 in the selected perforating gun 210.

The perforating gun assembly 200 may include short centralizer subs 220. In addition, tandem subs 225 are used to connect the gun barrels 212 end-to-end. Each tandem sub 225 comprises a metal threaded connector placed between the gun barrels 212. Typically, the gun barrels 212 will have female-by-female threaded ends while the tandem sub 225 has opposing male threaded ends.

An insulated connection member 230 connects the e-line 240 to the uppermost perforating gun 210. The perforating gun assembly 200 with its long string of gun barrels (the housings 212 of the perforating guns 210) is carefully assembled at the surface 105, and then lowered into the wellbore 10 at the end of the e-line 240 and connection member 230. The e-line 240 extends upward to a control interface (not shown) located at the surface 105. An operator of the control interface may send electrical signals to the perforating gun assembly 200 for detonating the shaped charges through the openings and for creating the perforations in the casing 150.

After the casing 150 has been perforated and at least one plug 112 has been set, the setting tool 160 and the perforating gun assembly 200 are taken out of the well 100 and a ball (not shown) is dropped into the wellbore 100 to close the plug 112. When the plug 112 is closed, a fluid, (e.g., water, water and sand, fracturing fluid, etc.) is pumped by a pumping system (not shown), down the wellbore 100 for fracturing purposes.

The above operations may be repeated multiple times for perforating and/or fracturing the casing 150 at multiple locations, corresponding to different stages of the well. Note that in this case, multiple plugs may be used for isolating the respective stages from each other during the perforating phase and/or fracturing phase. When all stages are completed, the plugs are drilled out and the wellbore is cleaned using a circulating tool.

It can be appreciated that a reliable electrical connection must be made between the perforating guns 210 in the tool string 200 through each tandem sub 225. Currently, electrical connections are made using either a percussion switch that has leads soldered on both ends, or a bulkhead that also has leads soldered on both ends. The use of soldered leads at each end adds work during the assembly process and creates what can sometimes be an uncertain electrical connection.

In addition to the soldering step, current assembly operations require that a communication wire be stripped by hand and then manually wrapped onto a contact pin. An insulation tubing is then manually installed over the contact pin to retain the electrical connection.

FIG. 3 demonstrates a known bulkhead 300 (sometimes referred to as a "bulkhead assembly") having a contact pin 320. Specifically, FIG. 3 offers a side, plan view of the bulkhead 300. The bulkhead 300 defines a body 310 having a generally circular profile. The body 300 has a first, or upstream end 312 and a second, or downstream end 314. However, these orientations may be reversed.

A pair of circular grooves is formed along the body 310 of the bulkhead 300. The grooves are configured to receive respective o-rings 322. The o-rings 322 preferably define elastomeric seals that closely fit between an outer diameter of the body 310 and a surrounding bulkhead receptacle within a tandem sub, such as subs 225.

The contact pin 320 extends through an inner bore (not shown) of the bulkhead 300. The contact pin 320 defines an elongated body 325 that is fabricated from an electrically conductive material. The contact pin 320 includes a contact head 321 that is in contact with an electrical detonator head within the gun barrel 210.

The bulkhead 300 is designed to be in electrical communication with an electrical wire 330. In FIG. 3, a portion of the wire 330 is shown in contact with a bulkhead connector 332. The wire 330 is in communication with insulated e-line 240 and receives detonation signals from the surface. A portion of an insulated cover is shown at 335.

The bulkhead 300 serves to relay the detonation (or initiation) signals to the detonator head (not shown). In operation, the operator will send a signal from the surface, down the e-line (such as e-line 240 of FIG. 2), through the body 325 of the pin 320, to the contact head 321, and into the gun barrel 210. From there, charges are detonated into the surrounding casing as discussed above. Where a series of gun barrels is used in a gun assembly, the signal from the wireline 330 will be transmitted through a series of gun barrels and a series of corresponding bulkhead assemblies 300 to the perforating gun 210 intended to be activated.

Because of the high pressure and high temperature environment that a gun barrel assembly experiences downhole, the bulkhead 300 is frequently fabricated from expensive and heavy metal materials. Therefore, a need exists for a bulkhead design that may be fabricated from a less expensive material while retaining sufficient strength. Further, a need exists for a bulkhead assembly wherein interlocking grooves are provided as between the electrical contact pin and the bulkhead body to increase shear strength of the bulkhead. Finally, a need exists for an improved electrical connection between the contact pin and a communication wire.

BRIEF SUMMARY OF THE INVENTION

A bulkhead assembly for transmitting current to a downhole tool is provided herein. Preferably, the downhole tool is a perforating gun though the downhole tool may alternatively be a logging tool. Preferably, the bulkhead assembly resides within a tandem sub between perforating guns.

In one embodiment, the bulkhead assembly first comprises a tubular bulkhead body. The bulkhead body has a first end, a second end, and a bore extending there between. Preferably, the bulkhead body is fabricated from a non-conductive material such as plastic (poly-carbonate) or nylon.

The bulkhead assembly further comprises an electrical contact pin. The contact pin comprises a shaft having a first end and a second end. The shaft extends through the bore of the bulkhead body, and frictionally resides within the bore. The contact pin is fabricated from an electrically conductive material for transmitting current from the first end to the second end. Preferably, the conductive material is brass, or a metal alloy comprised substantially of brass.

A contact head is provided at the second end of the electrical contact pin. The contact head is configured to transmit electrical current. The current is transmitted to a communication wire where electrical energy is then passed along to an adjacent perforating gun as electrical detonation signals. Preferably, the signal is sent to an addressable switch that is part of an electrical assembly.

Of interest, the shaft of the electrical contact pin comprises a plurality of grooves. At the same time, the receptacle comprises a profile for mating with the plurality of grooves. This grooved, mating arrangement increases the shear strength of the bulkhead assembly. In one embodiment, the plurality of grooves comprises at least three grooves equidistantly spaced along the shaft. More preferably, at least five grooves are provided.

In one aspect, the shaft comprises a conical portion proximate the first end. The conical portion frictionally fits into a mating conical profile of the receptacle. Preferably, the grooves of the electrical contact pin frictionally fit into the mating profile of the bulkhead body as well to prevent relative rotation.

Preferably, a first end of the electrical contact pin is in electrical communication with a wire (or electric line) within a wellbore. The wire transmits electrical signals from an operator at the surface. At the same time, a second end transmits current to a communications wire connected to a detonator within a next perforating gun. The "next" perforating gun is preferably an adjacent perforating gun located upstream from the tandem sub.

An improved tandem sub is also provided herein. The tandem sub includes a first end and an opposing second end. The first end comprises a male connector that is threadedly connected to a first perforating gun. At the same time, the second end comprises a male connector that is threadedly connected to a second perforating gun.

Each perforating gun preferably represents a carrier tube carrying charges. The carrier tube and charges, in turn, reside within a tubular gun barrel housing. Each gun barrel housing comprises opposing female threads for connecting to a respective end of the tandem sub.

The tandem sub also includes a receptacle. The receptacle resides within a bore of the tandem sub. The receptacle is dimensioned to closely receive a bulkhead. The bulkhead comprises:

- a tubular body having a first end, a second end and a cavity extending there between;
- an electrical contact pin having a shaft extending through the cavity of the bulkhead body and having a first end and a second end, wherein the shaft frictionally resides within the bore, and wherein the electrical contact pin is fabricated from an electrically conductive material for transmitting current from the first end to the second end; and
- a contact head located at the second end of the electrical contact pin extending outside of the bulkhead body.

The tandem sub also includes an electrical communication system. The electrical communication system serves as a wiring system for connecting the contact head to a communication wire. In this way, charge signals may be transmitted to a next perforating gun.

The electrical communication system comprises a connector terminal. The connector terminal places the contact head in electrical communication with the communication wire. The electrical communication system also includes an elastomeric, non-conductive boot. The boot encompasses the contact head at a first end, and the communication wire at a second opposing end. The boot comprises a flange at the first end.

The electrical communication system additional includes a castle nut. The castle nut circumscribes the boot while securing the flanged end of the boot against the bulkhead body. In this way, strain relief is provided to the communication wire.

Preferably, the shaft of the electrical contact pin comprises a plurality of grooves, while the bore comprises a profile for mating with the plurality of grooves. This provides increased shear strength for the bulkhead assembly.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

For purposes of the present application, it will be understood that the term "hydrocarbon" refers to an organic compound that includes primarily, if not exclusively, the elements hydrogen and carbon. Hydrocarbons may also include other elements, such as, but not limited to, halogens, metallic elements, nitrogen, carbon dioxide, and/or sulfuric components such as hydrogen sulfide.

As used herein, the terms "produced fluids," "reservoir fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, nitrogen, carbon dioxide, hydrogen sulfide and water.

As used herein, the term "fluid" refers to gases, liquids, and combinations of gases and liquids, as well as to combinations of gases and solids, combinations of liquids and solids, and combinations of gases, liquids, and solids.

As used herein, the term "subsurface" refers to geologic strata occurring below the earth's surface.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type, or to a set of geologic strata of different rock types that contribute to or are encountered in, for example, without limitation, (i) the creation, generation and/or entrapment of hydrocarbons or minerals, and (ii) the execution of processes used to extract hydrocarbons or minerals from the subsurface region.

As used herein, the term "wellbore" refers to a hole in the subsurface made by drilling or insertion of a conduit into the subsurface. A wellbore may have a substantially circular cross section, or other cross-sectional shapes. The term "well," when referring to an opening in the formation, may be used interchangeably with the term "wellbore."

Reference herein to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment.

Description of Selected Specific Embodiments

Figure 3:
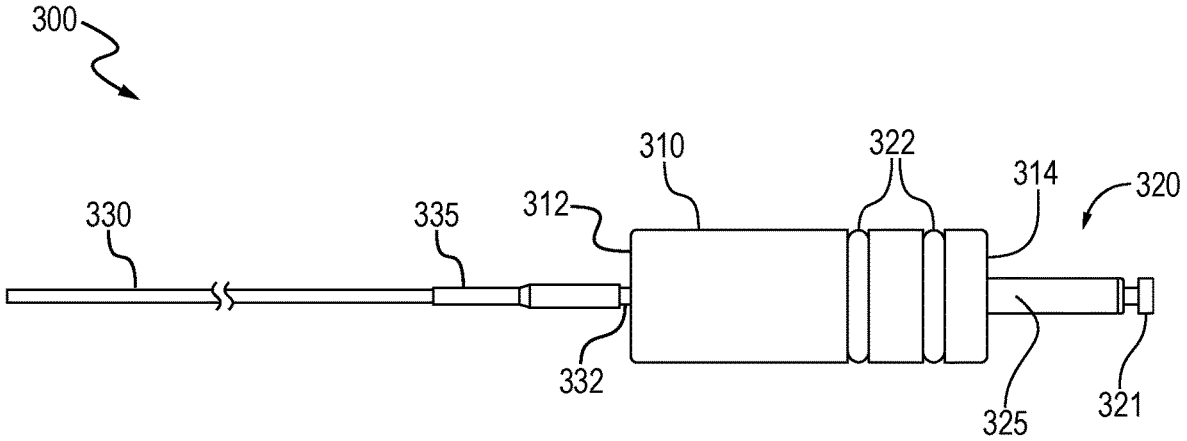
FIG. 3 (Prior Art)
FIG. 3 is a side, plan view of a known bulkhead assembly. In this view, an electrical wire is connected to an upstream end of the bulkhead assembly.
Figure 4A:
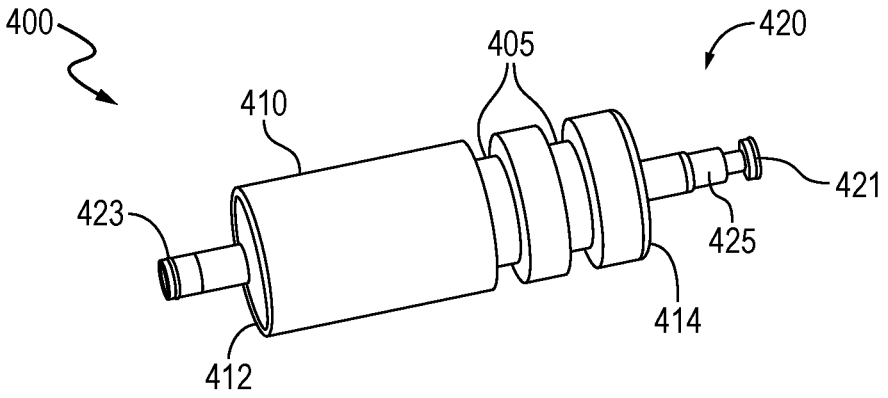
FIG. 4A is a perspective view of a bulkhead assembly of the present invention, in one embodiment.
Figure 4B:
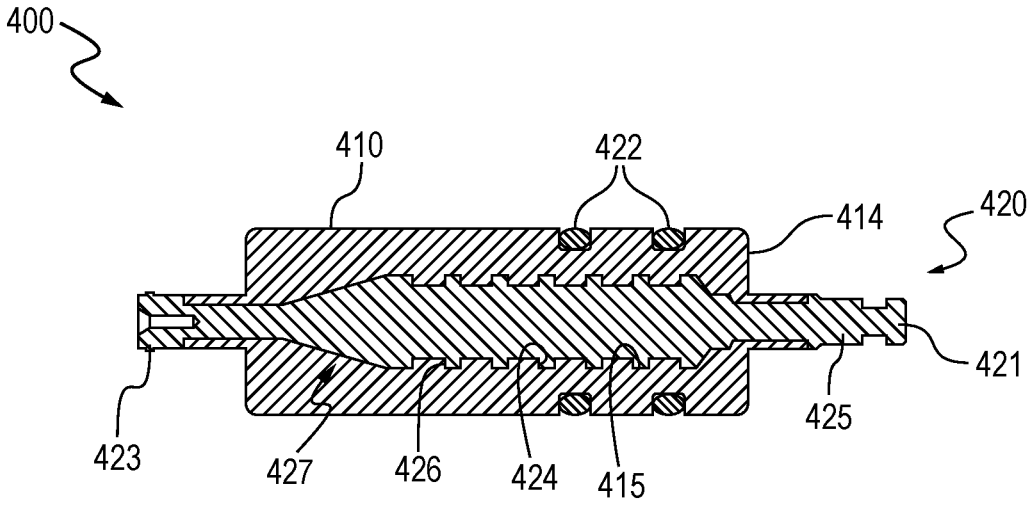
FIG. 4B is a cross-sectional view of the bulkhead assembly of FIG. 4A.

FIG. 4A is a perspective view of a bulkhead assembly 400 of the present invention, in one embodiment. FIG. 4B is a cross-sectional view of the bulkhead assembly 400 of FIG. 4A. The bulkhead assembly 400 is designed to transmit current to a downhole tool. Preferably, the downhole tool is a perforating gun, such as the perforating gun 300 of FIG. 3. Alternatively, the downhole tool may be a logging tool.

The bulkhead assembly 400 first comprises a bulkhead body 410. The bulkhead body 410 defines a somewhat tubular device. In this respect, the bulkhead body 410 includes an outer diameter and an inner diameter.

The bulkhead body 410 has a first end 412, a second end 414, and a bore (or cavity) 415 extending there between. The bore 415 represents the inner diameter referred to above, and is configured to serve as a receptacle. Preferably, the bulkhead body 410 is fabricated from a non-conductive material such as plastic (a poly-carbonate) or nylon.

The bulkhead assembly 400 further comprises an electrical contact pin 420. The contact pin 420 comprises a shaft 425 having a first end 423 and a second end 421. The shaft 425 is fabricated substantially from brass or other conductive metal. The shaft 425 extends through the bore 415 of the bulkhead body 410, and frictionally resides within the bore 415. The contact pin 420 transmits current from the first end 423 to the second end 421 in response to signals sent by the e-line 330.

The second end 421 of the shaft 425 defines a contact head. The contact head 421 is configured to transmit electrical signals to an adjoining perforating gun. This is done by sending the signals through a terminal to a communication wire associated with the adjoining, or downstream perforation gun.

Of interest, the shaft 425 of the electrical contact pin 420 comprises a plurality of grooves 426. At the same time, the receptacle (as a part of the bore 415) comprises a profile 424 for mating with the plurality of grooves 426. This grooved, interlocking arrangement increases shear strength of the bulkhead assembly 400, and particularly the bulkhead body 410.

In one embodiment, the plurality of grooves 426 comprises at least three grooves 426, and preferably five or even six grooves 426 equi-distantly spaced along the shaft 422.

Figure 1:
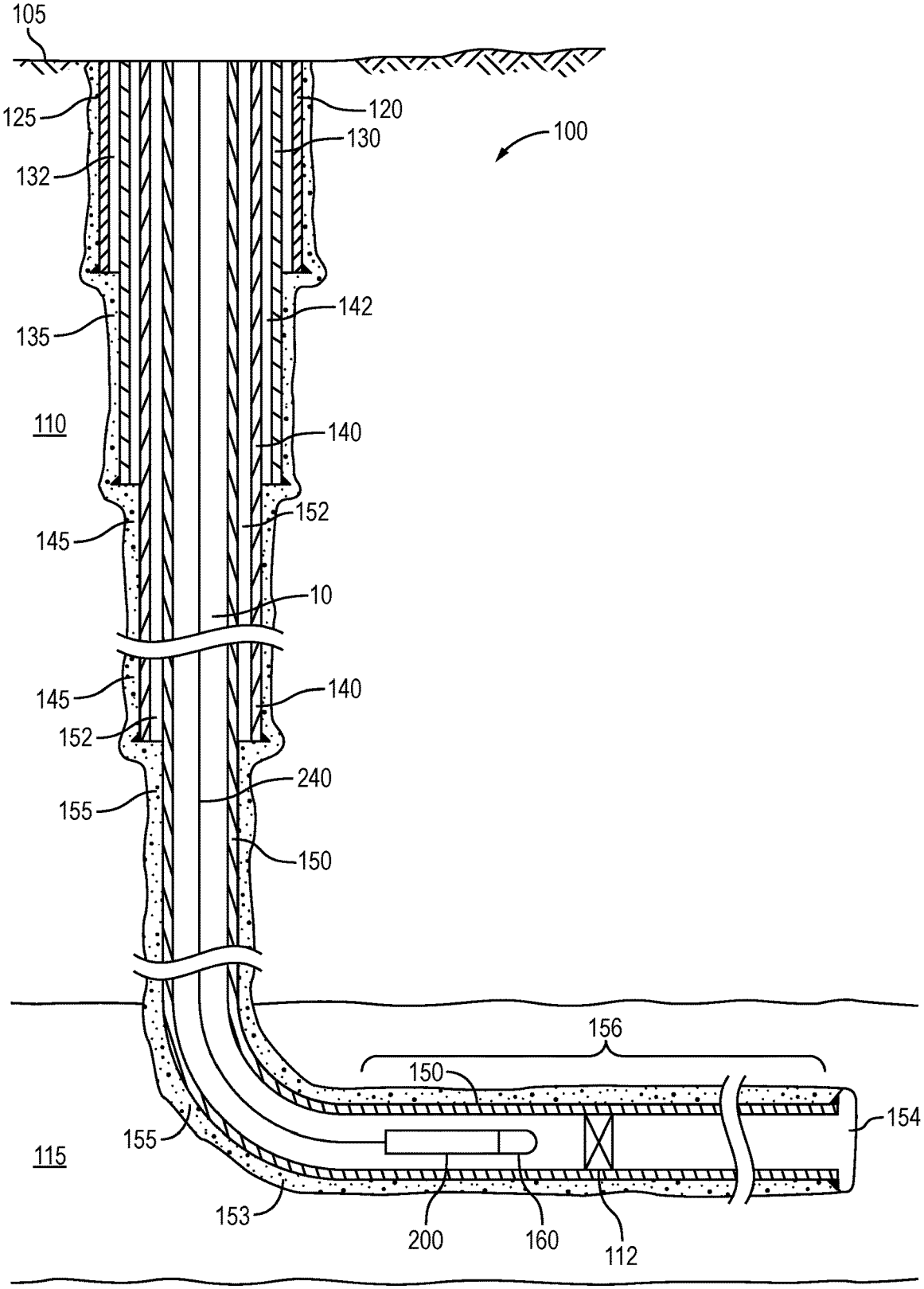
FIG. 1 (Prior Art)
FIG. 1 is a side, cross-sectional view of an illustrative wellbore. The wellbore is being completed with a horizontal leg. A perforating gun assembly is shown having been pumped into the horizontal leg.
Figure 2:
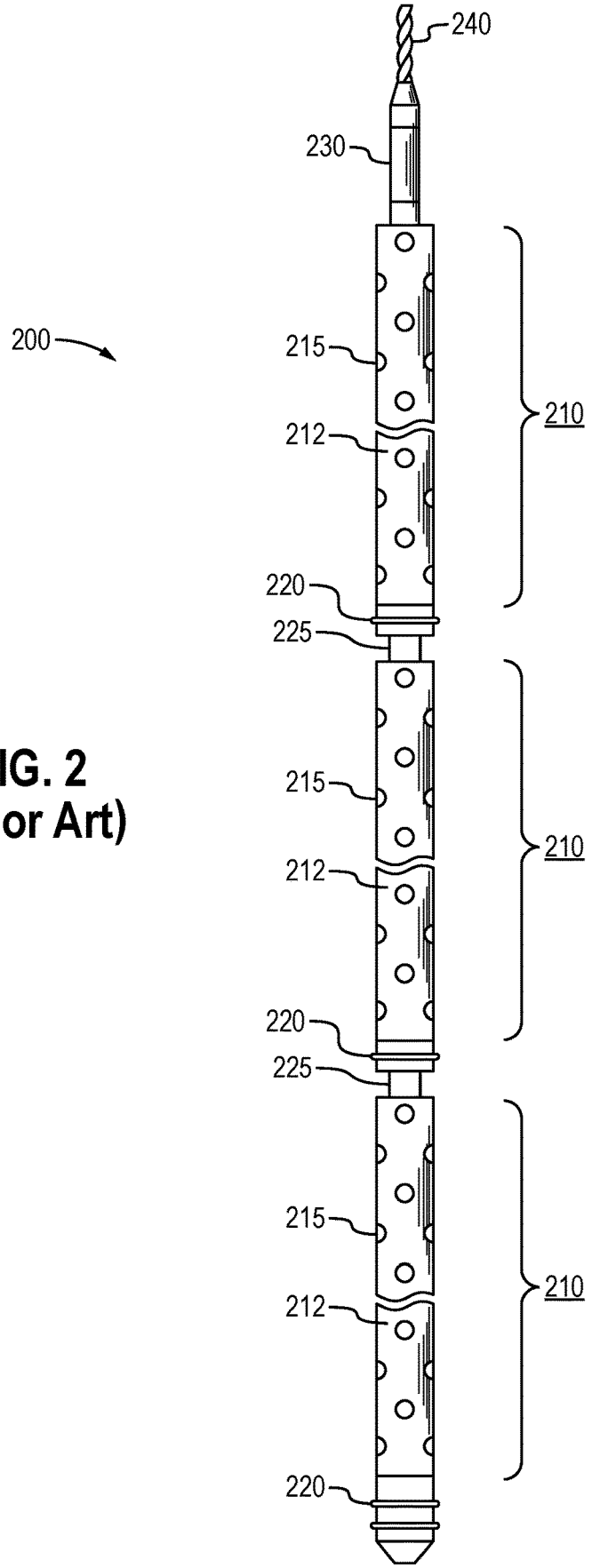
FIG. 2 (Prior Art)
FIG. 2 is a side, plan view of a known perforating gun assembly. In this view, a series of perforating guns is shown, spaced apart through the use of connecting tandem subs.

Preferably, the first end 423 of the electrical contact pin 420 is in electrical communication with a wire (such as wire 240 of FIG. 2) within a wellbore. The wire 240 transmits electrical signals from an operator at the surface. At the same time, the shaft 425 comprises a conical portion 427 proximate the first end 423 that frictionally fits into a mating conical profile (that is, the bore 415) for the receptacle. This further enhances shear strength of the bulkhead assembly 400.

Figure 5A:
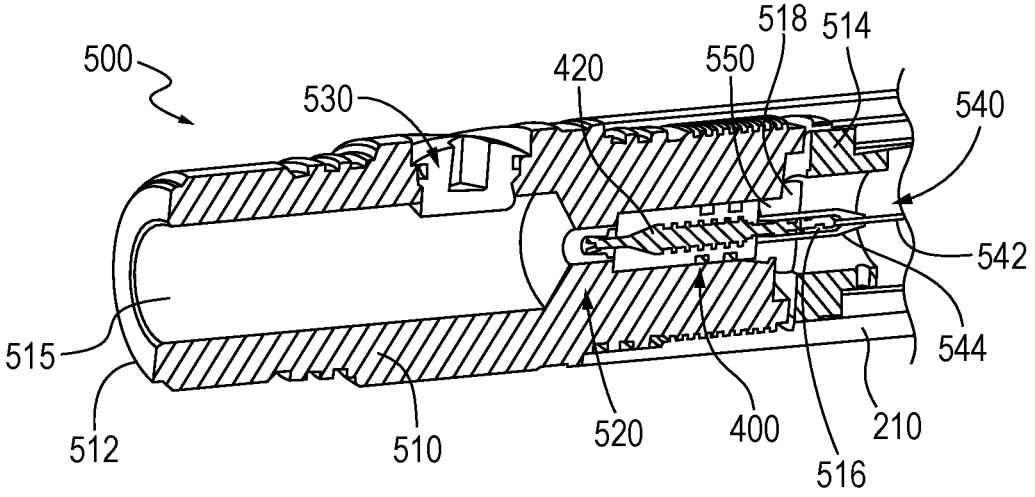
FIG. 5A is a cross-sectional view of the bulkhead assembly of FIG. 4 having been placed within a tandem sub. Visible in this view is a novel electrical connection with the contact pin of the bulkhead assembly.

FIG. 5A is a cross-sectional view of a tandem sub 500. The tandem sub 500 comprises a tubular body 510 having a first end 512 and a second end 514. The opposing ends 512, 514 define male connectors and are configured to threadedly connect with a female end of a perforating gun (as shown at 210 in FIG. 2).

The tandem sub 500 includes a receptacle 520. The receptacle 520 is dimensioned to closely receive the bulkhead 400 of FIGS. 4A and 4B. An optional wire entry port 530 is provided along the body 510 of the tandem sub 500.

The tandem sub 500 of FIG. 5A also includes a novel electrical communication system 540. The communication system 500 is designed to place a communication wire 542 in electrical communication with the contact head 421 of the electrical contact pin 420.

The electrical communication system 500 comprises a rubber boot 544. The rubber boot 544 extends from the communication wire 542 down over the contact head 421. A barrel connector terminal 516 is provided between the communication wire 542 and the contact head 421. The barrel connector terminal 516 resides within the rubber boot 544.

Of interest, the rubber boot 544 has a flange 518 that is captured under a standard castle nut 550 of the tandem sub 500. Together with the castle nut 550, the rubber boot 544 helps hold the communication wire 542 in place with the connector terminal 516, with or without soldering. The rubber boot 544 also provides strain relief to the communication wire 542 and guides the wire 542 into the tandem sub 500 during assembly.

Figure 5B:
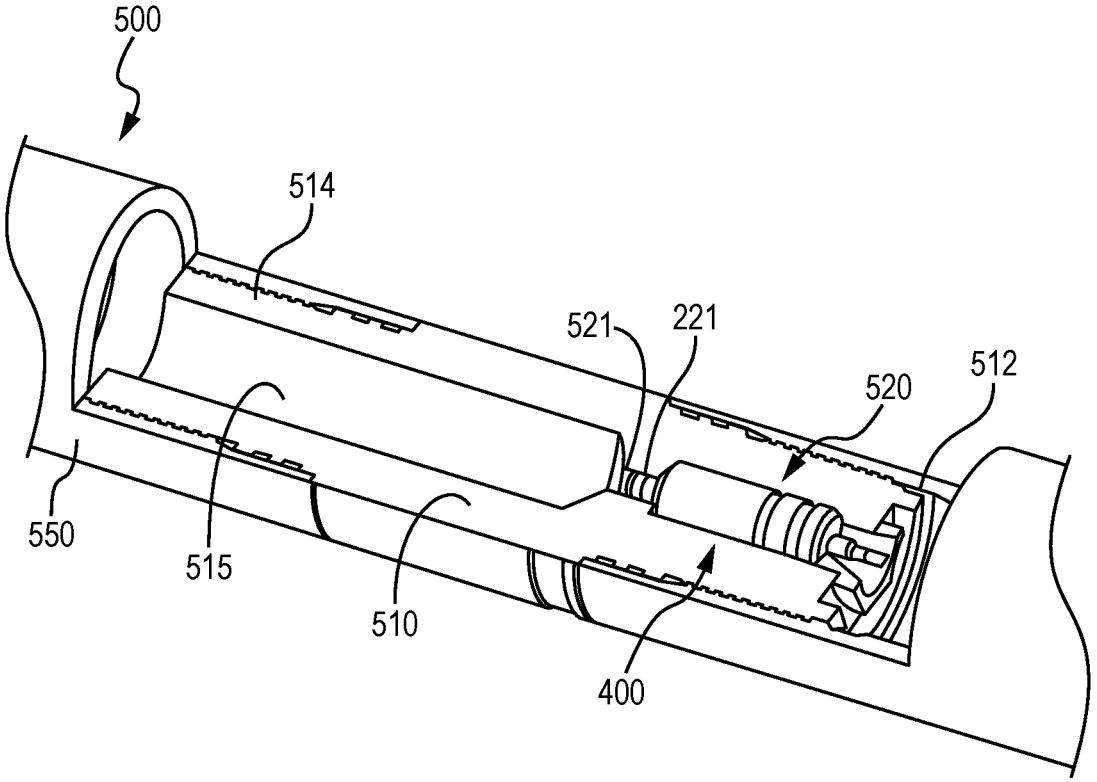
FIG. 5B is another cross-sectional view of the tandem sub of FIG. 5A. Here, the bulkhead is shown in perspective.

FIG. 5B is another cross-sectional view of the tandem sub 500 of FIG. 5A. Here, the bulkhead 400 is shown residing in the bore of the tandem sub 500, in perspective.

Figure 6:
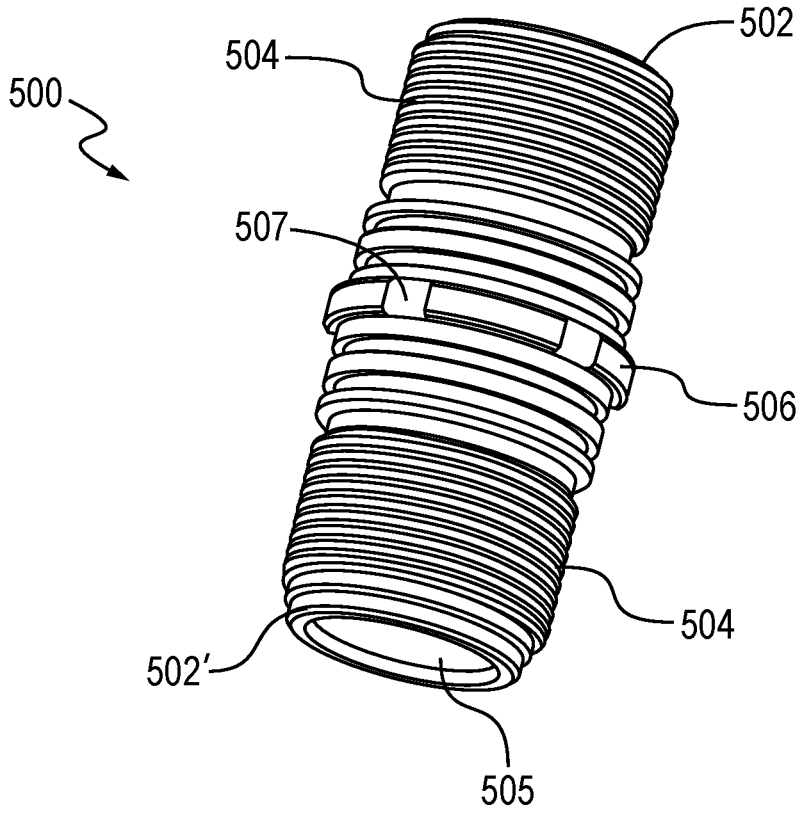
FIG. 6 is a perspective view of a tandem sub of the present invention, in one embodiment.

FIG. 6 is a perspective view of the tandem sub 500. The tandem sub 500 defines a short tubular body having a first end 502 and a second opposing end 502'. The tandem sub 500 may be, for example, 1.00 inches to 5.0 inches in length, with the two ends 502, 502' being mirror images of one another.

The tandem sub 500 includes externally machined threads 504. The threads 504 are male threads dimensioned to mate with female threaded ends of a gun barrel, such as gun barrels 212 of FIG. 2 The tandem sub 500 is preferably dimensioned in accordance with standard 3⅛" gun components. This allows the tandem sub 500 to be threadedly connected in series with perforating guns from any American vendor, e.g., GeoDynamics® and Titan®.

Intermediate the length of the tandem sub 500 and between the threads 504 is a shoulder 506. The shoulder 506 serves as a stop member as the tandem sub 500 is screwed into the end of a gun barrel 212. Optionally, grooves 507 are formed equi-radially around the shoulder 506. The grooves 507 cooperate with a tool (not shown) used for applying a rotational force to the tandem sub 500 without harming the rugosity of the shoulder 506.

The tandem sub 500 includes a central chamber 515. The central chamber 515 is dimensioned to hold an addressable switch and a stem (shown at 552 and 540, respectively, in FIG. 7). The addressable switch 552 is part of an electronic detonation assembly (shown partially in FIG. 8 at 550) that receives detonation signals from the electrical contact pin 420. The central chamber 515 ends at a conduit 521. The conduit 521 receives an end 421 of the contact pin 420. Opposite the conduit 521 from the central chamber 515 is the receptacle 520. As noted above, the receptacle 520 closely receives the bulkhead assembly 400.

Figure 7:
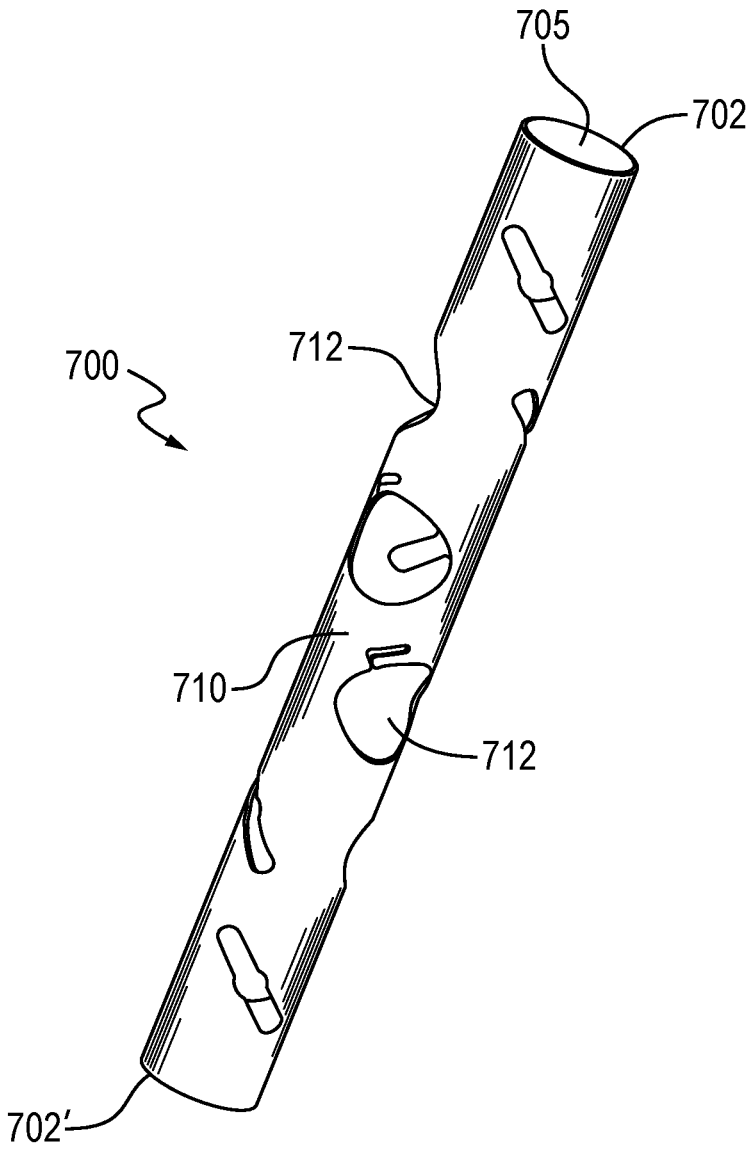
FIG. 7 (Prior Art)
FIG. 7 is a perspective view of an illustrative carrier tube for a perforating gun.

FIG. 7 is a perspective view of an illustrative carrier tube 700 for a perforating gun 210. The carrier tube 700 defines an elongated tubular body 710 having a first end 702 and a second opposing end 702'. The carrier tube 700 has an inner bore 705 dimensioned to receive charges (shown at 720 in FIG. 8). Openings 712 are provided for receiving the charges 720 and enabling the charges to penetrate a surrounding casing string 150 upon detonation.

Figure 8:
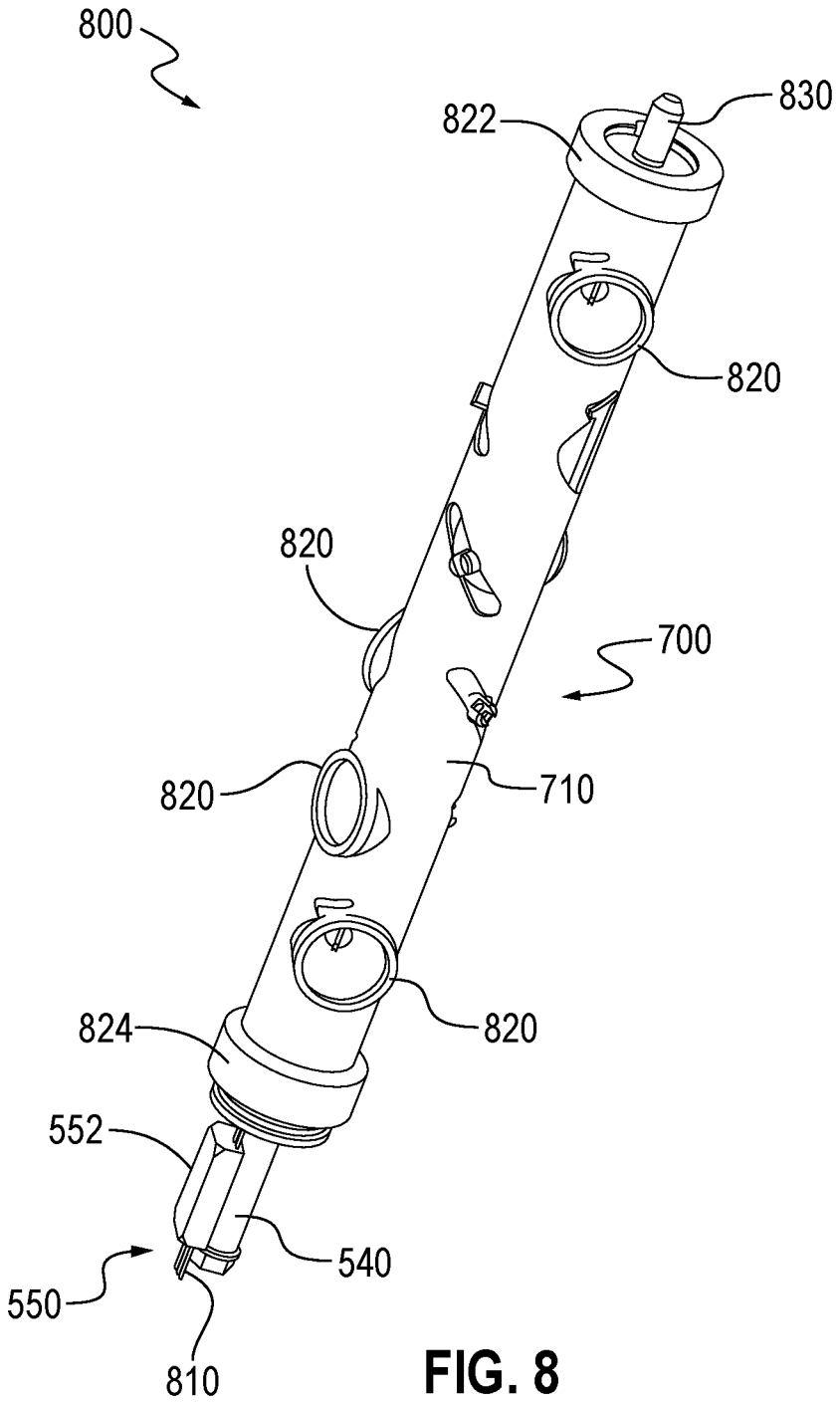
FIG. 8 is a perspective view of a perforating gun assembly of the present invention, in one aspect. A carrier tube having received shaped charges is shown with end plates having closed the top and bottom ends of the carrier tube.

FIG. 8 is a perspective view of the carrier tube 700 having received shaped charges 820. Each shaped charge 820 is designed to detonate in response to an electrical signal initiated by the operator at the surface. End plates 822, 824 have mechanically enclosed top and bottom ends of the carrier tube 700, respectively. The end plates 822, 824 help center the carrier tube 700 and its charges 820 within an outer gun barrel (not shown in FIG. 8 but shown at 212 in FIG. 2).

An electronic detonator and a detonating cord (not shown) reside inside the carrier tube 700. The carrier tube 700 and charges 820 together with the gun barrel 212 form a perforating gun 210, while the perforating gun along with the end plates 822, 824, the detonating cord and the detonator form the perforating gun assembly 800. In some cases the term "perforating gun assembly" is used in the industry to also include an adjacent tandem sub and electronics, and possibly a series of perforating guns 210 such as in FIG. 2. The carrier tube 700 and the gun barrel 210 are intended to be illustrative of any standard perforating gun, so long as the gun provides a detonator and detonating cord internal to the carrier tube 700.

An insulator 830 extends from the top end plate 822 of the perforating gun assembly 800 of FIG. 8. The insulator 830 then transports electrical wires on to a next tandem sub 400. At an opposing end of the insulator 830 and adjacent the bottom end plate 824 will be the tandem sub (not shown). The addressable switch 552 and stem 540 reside in the tandem sub, and more specifically within the chamber 515. Wires 810 extend from the addressable switch 552 and travel from the tandem sub 500 to a detonator (not shown) in an adjacent perforating gun.

Further, variations of the tool and of methods for using the tool within a wellbore may fall within the spirit of the claims, below. It will be appreciated that the inventions are susceptible to other modifications, variations and changes without departing from the spirit thereof.

We claim:

1. A tandem sub for a perforating gun assembly, comprising: a first end comprising a male connector, the first end being threadedly connected to a gun barrel housing associated with a first perforating gun; a second opposing end also comprising a male connector and being threadedly connected to a gun barrel housing associated with a second perforating gun; a bore extending from the first end to the second end, with the bore comprising a receptacle, and with the receptacle being dimensioned to closely receive a bulkhead, wherein the bulkhead comprises: a tubular body having a first end, a second end and a cavity extending there between; an electrical contact pin having a shaft extending through the cavity of the tubular body and having a first end and a second end, wherein the shaft frictionally resides within the cavity, and wherein the electrical contact pin is fabricated from an electrically conductive material for transmitting current from the first end to the second end; and a contact head located at the second end of the electrical contact pin and extending outside of the bulkhead body the first end of the electrical contact pin extends outwardly from the tubular body and is in electrical communication with an electric line within a wellbore, the electric line transmits electrical signals from a surface, the shaft of the electrical contact pin comprises a plurality of grooves, while the cavity comprises a profile for mating with the plurality of grooves, thereby providing increased shear strength for the bulkhead, and the shaft further comprises a frusto-conical portion proximate the first end of the shaft that frictionally fits into a mating conical profile of the bore.

2. The tandem sum of claim 1, wherein:

the current represents detonation signals sent from the surface, down the electric line, and to the tandem sub.

3. The tandem sub of claim 1, further comprising:

an electrical communication system for connecting the contact head to a communication wire for transmitting charge signals to the second perforating gun.

4. The tandem sub of claim 3, wherein the electrical communication system comprises:

a connector terminal placing the contact head in electrical communication with the communication wire, an elastomeric, non-conductive boot encompassing the contact head at a first end, and the communication wire at a second opposing end, wherein the boot comprises a flange at the first end, and a castle nut circumscribing the boot configured to secure the flanged end of the boot against the bulkhead body, thereby providing strain relief to the communication wire.

5. The tandem sub of claim 2, wherein:

the tubular body of the bulkhead is fabricated from a non-conductive material; and the electrical contact pin is fabricated substantially from brass.

6. The tandem sub of claim 2, wherein the non-conductive material comprises a poly-carbonate material or nylon.

7. The tandem sub of claim 6, wherein the plurality of grooves comprises at least three grooves equi-distantly spaced along the shaft between the first end and the second end of the shaft.

* * * * *